US007426890B2

(12) United States Patent
Olvey

(10) Patent No.: US 7,426,890 B2
(45) Date of Patent: Sep. 23, 2008

(54) FORCE-RESISTING SUPPORT ASSEMBLY

(76) Inventor: Susan Olvey, 554 Nantucket Ct., #104, Altamonte Springs, FL (US) 32714

( * ) Notice: Subject to any disclaimer, the term of this patent is extended or adjusted under 35 U.S.C. 154(b) by 275 days.

(21) Appl. No.: 10/666,950

(22) Filed: Sep. 18, 2003

(65) Prior Publication Data

US 2004/0108434 A1 Jun. 10, 2004

Related U.S. Application Data

(60) Provisional application No. 60/411,661, filed on Sep. 18, 2002.

(51) Int. Cl.
*B65D 19/00* (2006.01)
*B65D 19/12* (2006.01)
*B65D 19/16* (2006.01)

(52) U.S. Cl. ..... 108/51.3; 108/56.1

(58) Field of Classification Search ..... 108/51.11, 108/51.3, 52.1, 56.1, 57.33, 57.34
See application file for complete search history.

(56) References Cited

U.S. PATENT DOCUMENTS 2,709,559 A * 5/1955 Geisler ..... 108/51.3
2,908,464 A * 10/1959 Traudt et al. ..... 108/51.3
4,875,419 A * 10/1989 Helton et al. ..... 108/56.1
5,469,795 A * 11/1995 Moorman ..... 108/51.3
RE35,131 E * 12/1995 Youell et al. ..... 108/51.3
5,484,241 A * 1/1996 Haywood et al. ..... 410/154
6,029,582 A * 2/2000 Ogilvie et al. ..... 108/51.3
6,155,181 A * 12/2000 Chilcutt ..... 108/51.3

* cited by examiner

*Primary Examiner*—Janet M Wilkens
*Assistant Examiner*—Timothy M Ayres
(74) *Attorney, Agent, or Firm*—Timothy H. Van Dyke; Beusse Wolter Sanks Mora & Maire

(57) ABSTRACT

The present invention is a force resisting assembly, and can be constructed into a pallet or dunnage support made from paperboard that minimizes adverse environmental impact, occupies little space before it is configured, and effectively saves production, storage and transportation costs. The present paperboard assembly can be shipped and stored as either one or more die-cut and scored paperboard pieces, thereby eliminating excess volume, with the pieces being readily interconnectable to form a complete pallet or dunnage support assembly. Preferably, the paperboard of the present invention further has a low moisture vapor transmission rate (MVTR), excellent glueability and recyclability.

7 Claims, 12 Drawing Sheets

20
18
20
260
252
126

304
212
20
18
14

6
6
5
5
304
202
224
220
222
width

FORCE-RESISTING SUPPORT ASSEMBLY

CROSS-REFERENCE TO RELATED APPLICATIONS

This application is related to U.S. provisional patent application No. 60/411,661 filed Sep. 18, 2002, and claims priority to such application under 35 USC § 119(e). The disclosure and teachings of provisional patent application No. 60/411,661 are incorporated herein.

BACKGROUND OF THE INVENTION

1. Field of the Invention

The present invention relates generally to a load-force-resisting assembly, and specifically to a pallet or dunnage support constructed of paperboard that minimizes adverse environmental impact, occupies little space before it is configured, and effectively saves production, storage, and transportation costs.

2. Description of Related Art

A pallet is primarily used to handle materials in large quantities and typically comprises a flat, elevated surface to support containers or packages a sufficient distance from a surface such as a floor to permit the forks of a forklift to be inserted under them so that the pallet supporting the load can be moved from place to place. For the purpose of transporting products, using pallets to carry goods is simple, economical, and efficient.

Most pallets have been made of wood. Of the available materials prior to a new technology in paperboard construction being developed, softwood provided the best balance of both strength and cost.

However, a number of problems face users of conventional wooden pallets. The cost of making and repairing wooden pallets is rising at a rate that is detracting from the cost effectiveness of palletized shipment. Moreover, empty wooden pallets require substantial space for storage, and it is especially costly to transport empty pallets by rail or truck for reuse.

In an effort to reduce costs, many wood pallet producers have resorted to using lower grades of unseasoned or untreated lumber commonly known as "pallet lumber." Pallet lumber typically has a rough finish and is prone to cracking, warping, or the like. Further, such rough finishes present a splinter hazard and are unsuitable for some uses, including food-handling applications. Such low grades of lumber also readily split or break, resulting in pallet failure.

Conventional types of pallets must be returned to the shipper after use so the shipper can reuse them, if possible, or the pallets have to be disposed of in a proper manner. Yet, wood pallets are bulky which makes them inconvenient to store and return to the shipper. Damaged wooden pallets generally cannot be taken to a landfill or other waste disposal site. Rather, they must be reduced either by chipping or burning before disposal. Chipping is a significant problem inasmuch as nails and other metal fasteners must be removed from the pallet wood before the chipping operation can be undertaken, adding significant cost to pallet reduction. By the same token, increasingly stringent environmental regulations often preclude the burning of used pallets.

Disposal of the conventional wood and nail pallets is a more serious problem when such pallets are exposed to chemical or biochemical materials that contaminate the pallet, since contaminated parts of the pallet can not be destroyed through incineration. The contaminated parts of the pallets often must be disposed in a hazardous waste landfill, which disposal is also inconvenient and expensive.

As forest resources also have been declining in recent years, pallets constructed of plastic and metal have been developed. While it is true that higher pressure-resistant strength is an advantage of pallets made of plastic and metal, in terms of environmental protection these two other types of pallet material no longer meet the requirements of environmental preservation. Additionally, the heavier pallet materials of plastic and metal pallets do not satisfy economic efficiency when weight is the basis for the calculation of transportation costs.

Thus there has been a long-felt need for a pallet that is lightweight, inexpensive, and strong, and has smooth outward surfaces, that is formed of an alternate material other than wood, plastic, or metal.

A demand presently exists for recyclable materials such as corrugated paperboard boxes that may be readily remanufactured into recycled corrugated paperboard. Recyclability provides future cost efficiencies on a large scale. Paperboard is a largely homogenous material (with the exception of minor amounts of adhesive and printing ink, which are acceptable in the recycling process) and may be readily collected at a number of discrete sites (e.g., warehouse, factory, retail store, or the like). In some instances, pallets are used to support a number of corrugated containers (e.g., boxes) which may be attached to the pallet using suitable means (e.g., strapping, shrink-wrapping, or the like). Thus it is desirable to provide a pallet that can be recycled in the same material stream as its accompanying corrugated containers.

There have been a variety of attempts over the years to replace wooden pallets with those constructed of paperboard. However, past paperboard pallets were not as sturdy as wooden pallets, were more costly, and required inside storage, and none of them received widespread acceptance. In recent years, attempts also have been made to replace the bulky and expensive wooden pallets with solid paperboard sheets called slip-sheets. These slip-sheets simply comprise a sheet of solid paperboard that is slightly larger than the dimensions of the goods to be stacked thereon. The slip-sheet is neither intended for nor capable of supporting the weight of the stacked goods, and must always be supported on a suitable horizontal surface, by using a conventional pallet, or handled with specially designed equipment. By providing an extra marginal edge of solid board material, it is possible to grasp and slide the sheets and the goods carried thereon about the floor or onto a specially designed lift truck.

While slip-sheets have provided cost savings in many industrial situations, they simply are not suitable to fully replace palletized shipments. For example, difficulties have been encountered where heavily loaded slip-sheets are positioned directly adjacent the doorway of a fully loaded boxcar or truck trailer. When so positioned, the lift truck mechanism is unable to grasp a sufficient portion of the slip-sheet to pull it onto the lift truck. A slip-sheet improperly grasped is often ripped. This has necessitated, in many situations, unloading the sheet to move the goods out of the carrier and then restacking the goods on the sheet for transport by a lift truck.

An all-corrugated paperboard pallet is desirable, as it can be recycled along with any corrugated containers carried on the pallet. In warehouses and retail stores it is known to provide a separate compactor for compacting and storing corrugated waste. Such waste can then be retrieved and recycled into new corrugated material. In addition to the designs noted above, several attempts have been made to produce an all-corrugated paperboard pallet by mimicking the design of a wood pallet, using layers of corrugated paperboard in place of wood boards. Such pallets are heavy and expensive, as they attempt to achieve the equivalent strength of a wood pallet, and comprise several layers of corrugated material (e.g., as many as 16 layers).

Another requirement of a practical pallet design is that the pallet be suitably moisture and water resistant. Water spills, rain, and condensation may be present in warehouses, loading docks, trucks, railcars, and the like. In many instances a pallet may be placed in proximity to a location where a risk of flooding may occur leaving the pallet placed in a small amount of standing water. Corrugated paperboard pallets of the prior art are not suitably equipped to sustain such moisture conditions. Moreover, alternative pallet designs of paper core, wood, and paper pulp will often disintegrate under such conditions.

A novel corrugated paperboard pallet design is desired that is capable of overcoming the numerous disadvantages of the conventional pallet, and can be made from a converted or remanufactured paper product. In most applications, the corrugated paperboard is a layered structure that is usually die-cut to form corrugated structures. It consists of a fluted corrugated medium sandwiched between sheets of linerboard. The simplest three-ply structure is known as "double wall." As recently as 1990, much of the linerboard was made entirely from virgin, long-fibered, softwood, kraft pulp. At present, however, these board grades contain sizeable portions of recycled old corrugated containers (OCC) and many are made from 100% OCC.

Around the country, and even in the rest of the world, landfill space for waste disposal is rapidly reaching capacity. By the year 2000, paper and paperboard products are projected to represent 40.9 percent of the municipal solid waste stream and may climb to nearly 42 percent by 2010. New governmental regulations and the public's increasing concern for the environment have created pressure to remove these materials from the solid waste stream. The most widely utilized method of reducing paper waste is recycling.

OCC has a history of efficient recycling use. Even before the era of government mandates and self-imposed industry goals, almost 50% of OCC was recycled in North America. The recovery rate as of 1999 was about 62%. Past estimates indicated that a level of 70% would be achieved by the year 2000. Most of this recycled material goes directly from retail chain stores and factories to mills based on long-term contracts. The rest comes from municipal curbside collection and wastepaper dealers. Some OCC is used in the production of boxboard, and some is even bleached and used in the production of fine paper, but most OCC is used again to produce corrugating medium and linerboard. "Repulping" refers to any mechanical action that disperses dry or compacted pulp fibers into a water slush, slurry or suspension. The action can be just sufficient to enable the slurry to be pumped, or it can be adequate to totally separate and disperse all the fibers. In a typical recycling process, bales of OCC are fed into a repulper, where the material is disintegrated and the gross contaminants are removed. The resulting stock is pumped through pressure screens and cyclonic cleaners to remove oversized materials and foreign matter. Reverse cleaners remove plastics, STYROFOAM® or other lightweight contaminants. The glue, staples, wax, and tapes originally used to assemble the corrugated box must be removed.

Untreated OCC usually creates no problems for recycling. However, paperboard is often treated or coated to enhance its performance and these coatings render the paper unrecyclable. For example, corrugated paperboard is often treated with a curtain coating, wax impregnation, lamination, sizing, or a water-based coating to reduce abrasiveness and to provide for oil and moisture resistance. Moisture vapor transfer rate (MVTR) is a scientific measurement used to describe a product's ability to allow moisture vapor to pass through it, over a specific time period, at a controlled temperature and at a designated atmospheric pressure. While coatings such as wax enhance the moisture-resistance properties of the paperboard, the wax coating process is expensive and often renders the paperboard unrecyclable.

In pallet construction, excessive moisture gain can cause a corrugated paperboard pallet to lose its integrity and fail during use, which potentially could lead to heavy economic losses. Traditional solutions generally involve plastic film, either as a laminate with the paperboard or as a bag around the pallet. Both solutions are expensive or incur added labor costs, and greatly reduce or eliminate the recyclability of the pallet. Therefore, there exists a need in the art for coatings that can provide the high moisture resistance needed without compromising the recyclability of the pallet.

The MVTR of a corrugated paperboard pallet is dependent not only upon the coating on the paperboard, but also the method by which that coating is applied. Traditional methods of coating application, such as a rod coater or a blade coater, may result in variations in coating thickness that will cause variations in the MVTR of the coating. The typical solution to this problem has been to merely increase the amount of coating applied to the paperboard. This solution can be expensive and does not result in a consistently coated product both linearly and across the paperboard web.

Conventional dunnage support assemblies are frequently employed when transporting industrial articles from one location to another. Known dunnage support assemblies typically comprise a dunnage support member that is secured to a rigid frame. The dunnage support member itself is formed of an elastomeric material and has a surface adapted to engage and support the dunnage for transportation. The elasticity of the dunnage support member protects the dunnage from damage that might otherwise result from jarring and vibration during transport.

There have been a number of previously known shipping containers for dunnage, specifically shipping containers for heavy industrial components, such as automotive engines. These previously known shipping containers typically comprise a frame constructed of a rigid material, such as tubular steel. Furthermore, each container is usually designed to transport a number of the industrial components.

Typically, these elastomeric dunnage support members are formed from polyisocyanate that reacts with a resin. The reaction itself is carried out within a mold so that the mold, which conforms in shape to the dunnage support member, forms the part in the desired final shape. Such dunnage support members further can be custom fabricated for the particular dunnage to be transported.

The disposal of previously known dunnage supports after their useful life, however, presents problems, not unlike the problems associated with damaged wood and plastic pallets. The elastomeric material formed by the reaction of polyisocyanate and resin cannot be recycled and, instead, must be disposed of in a landfill or an equivalent. Such disposal is not only expensive, but also presents potential hazards to the environment.

U.S. industry has been moving toward the elimination of foam dunnage supports and packaging comprising polystyrene and other foams, principally because of adverse environmental impacts of such type packaging, and accordingly, efforts are directed toward providing a dunnage support that is recyclable. Industries utilizing dunnage supports are varied, and span from the furniture industry to the automobile industry. Any product that is shipped can be protected from scratches, dents, and other forms of damage by some sort of dunnage support assembly.

The elastomeric material formed for use as a dunnage support generally is an isomeric material that is spongy. Consequently, once the products are wedged between spaced-apart dunnage support members, the spongy elastomeric material compresses slightly and cushions the dunnage. Another disadvantage of the conventional dunnage support assembly is that the shipping container is often subjected to high impact during transport. This is especially true when train transports the shipping container. In such situations, the spongy dunnage support members have been known to crumble or otherwise abrade during transport. Such abrasion or crumbling of the elastomeric material is unacceptable since it can result in damage to the dunnage.

Currently wooden and plastic dunnage supports are also known to be used. These materials form supports, however, that are substantially unyielding, which promotes the packaging of the supported components to rely solely upon the internal protection of the individual container in which the material being shipped is encased.

Thus it can be seen that there is a need for a force-resisting structure that upon construction can be used both as a pallet or a dunnage support, which structure comprises board that is capable of minimizing both environmental pollution and transportation expenses, occupying little space before it is configured, and effectively saving production and storage costs. Preferably, the paperboard pallets and dunnage support assemblies should have a low moisture vapor transmission rate, excellent glueability, and recyclability.

SUMMARY OF THE INVENTION

Briefly described, in its preferred form, the present invention forms a force-resisting assembly comprising a lower and upper frame member foldably constructed from corrugated or solid paperboard blanks. Each frame member comprises ribs having alignment/locking slots. The lower and upper frame members differ in dimensions, but in a preferred form incorporate nearly identical (or identical) elements, thus simplifying production of the blanks and the folding steps necessary to form the present structure. The ribs of the lower frame member align/lock into the alignment/locking slots of the ribs of the upper frame member, and the ribs of the upper frame member align/lock into the alignment/locking slots of the ribs of the lower frame member.

The paperboard of the present assembly can comprise numerous embodiments, including a medium between two sheets of linerboard or be multi-layered, and incorporate a variety of flute designs. The flute sizes and thickness can be customized to meet specific requirements of strength and flexibility. Preferably, the force-resisting structure assembled into a pallet provides for four-way entry for forklift maneuverability, and may be sent to the end user either in assembled form, or in flat blank form. Formed as a pallet, the present assembly is more aptly termed a load-bearing assembly supporting containers and the like above the floor.

The present invention constructed and used as a pallet eliminates numerous disadvantages associated with the use of conventional permanent pallets. The present pallet comprises relatively inexpensive materials such as paperboard, and is secured together without the need for glue or other adhesives. The present pallet is configured such that it is stabilized by special locking assemblies and peripheral structures (e.g. edge panels). Unlike typical corrugated pallets, the special design and construction of the present pallet alleviates any need for adhesives. This feature makes possible other advantageous features. For example, it is known in the industry that corrugated pallets cannot typically be used in moist environments, as water can soak into and ruin the pallet. To combat this problem, pallets can be treated with a curtain coating, wax impregnation, lamination, polyester coating, sizing, or a water-based coating to reduce abrasiveness and to provide for oil and moisture resistance. However, adhesives such as glue have difficulty properly sticking to a treated corrugated material. Prior to the subject invention, there have not been assembled corrugated pallets that could maintain their integrity without use of an adhesive to some sort. Thus, the subject pallet or dunnage system provides an effective pallet that can be made using a treated material. Though not preferred, and not needed, it is understood that conventional adhesives such as glue can be used to further stabilize and secure the pallet. The use of such adhesives would not interfere with the recyclability of the paperboard; so the pallets remain recyclable, disposable in municipal landfills, and inexpensive to manufacture. The pallet of the present invention is also easy to dispose of in case of contamination due to product spills or damage because all of the materials of construction are biodegradable or can be incinerated without further disassembly. The pallets are lightweight and have great structural strength. Thus the pallets of the instant invention are especially suited for assembly line work for containing or supporting parts that must be supported or stacked in that the worker need not have to handle the weight of a traditional wood and nail pallet. Moreover, the manufacturer does not have the expense of providing lightweight plastic pallets, which are usually too costly to use for operations requiring disposal or destruction of the pallet due to contamination.

These advantages of the present assembly forming a pallet equally apply to the assembly forming a dunnage support. As a dunnage support is placed between two or more surfaces, the present invention resists the forces generated when the surfaces are brought toward one another during settlement or transportation shifting.

The method at which the current design is formed and assembled creates a resilient dunnage support that assists in protecting shock-sensitive components such as electrical/electronic devices, an improvement over previously known devices.

The objects, features, and advantages of the present invention will become more apparent upon reading the following specification in conjunction with the accompanying drawing figures.

DETAILED DESCRIPTION OF THE PREFERRED EMBODIMENTS

A detailed description of the preferred embodiments of the present invention will now be presented with reference to FIGS. 1-18.

Briefly described, in a preferred form, the present invention provides a force-resisting paperboard assembly that can be used both as a pallet and a dunnage support having high moisture resistance, which assembly is foldably constructed from two flat, die-cut blanks to form, for example, a pallet having a generally flat upper surface for supporting containers or packages a sufficient distance from the floor to permit the forks of a forklift to be inserted under them so that the pallet supporting the load can be moved from place to place. The pallet construction virtually eliminates negative environmental impact and minimizes the shipper's transportation expenses associated with conventional pallet constructions.

The following detailed descriptions of preferred embodiments will mainly refer to a force-resisting assembly formed as a pallet, yet use of the term pallet generally may be interchanged for the terms dunnage support assembly, as the construction of both is similar. When the construction of the pallet diverges from the construction of the dunnage support assembly, special notice will be made in the description.

The present invention further is directed to a machine for making the pallet of the present invention and a method of making the pallet.

Figure 1:
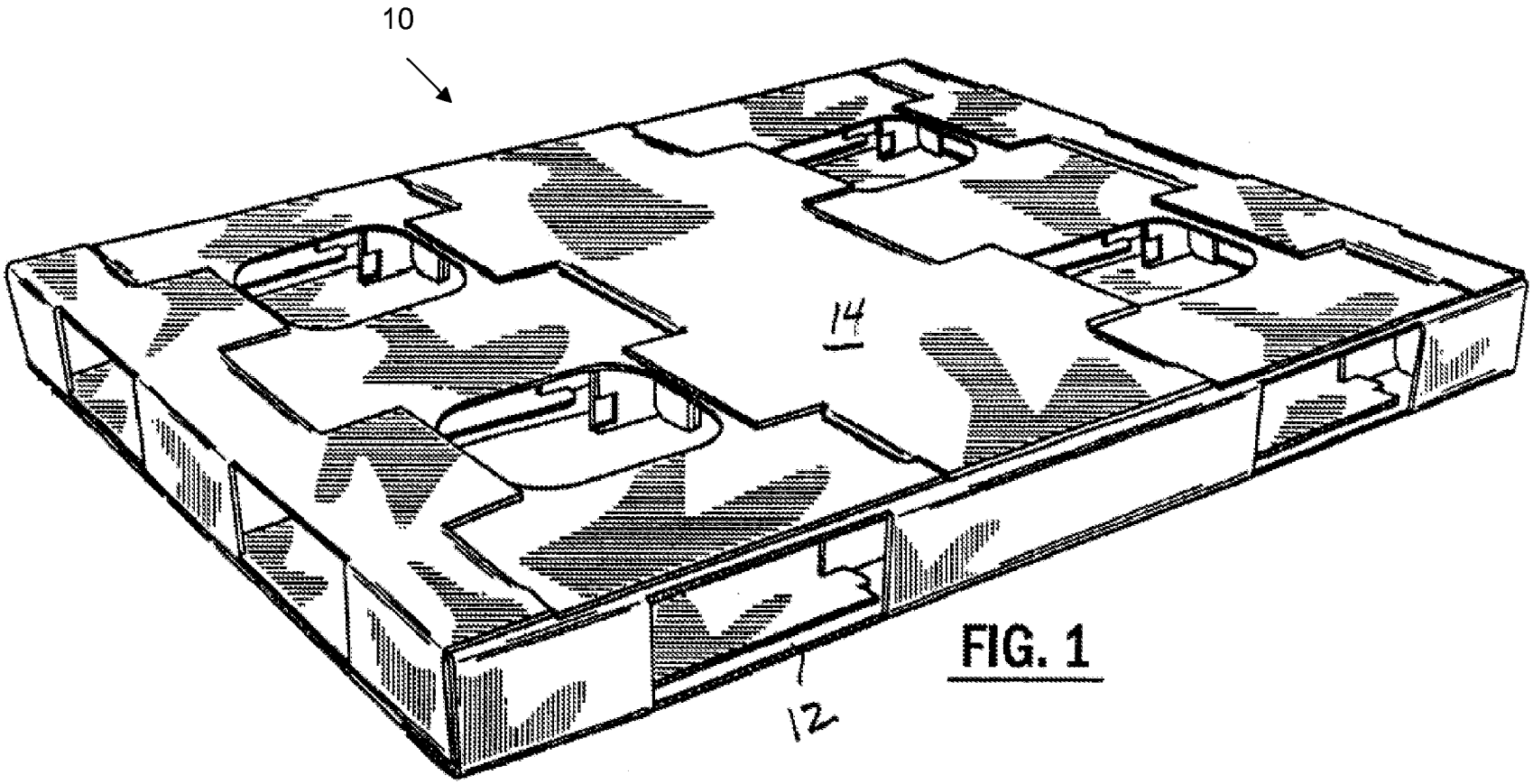
FIG. 1 is a top-corner perspective view of the foldable paperboard force-resisting assembly of the present invention in its assembled configuration.

Referring now in detail to the drawing figures, wherein like reference numerals represent like parts throughout the several views, FIG. 1 shows an assembled pallet 10 of the present invention, which pallet 10 generally comprises a lower frame member 12 and an upper frame member 14, both of which are foldably constructed from blanks.

Figure 2:
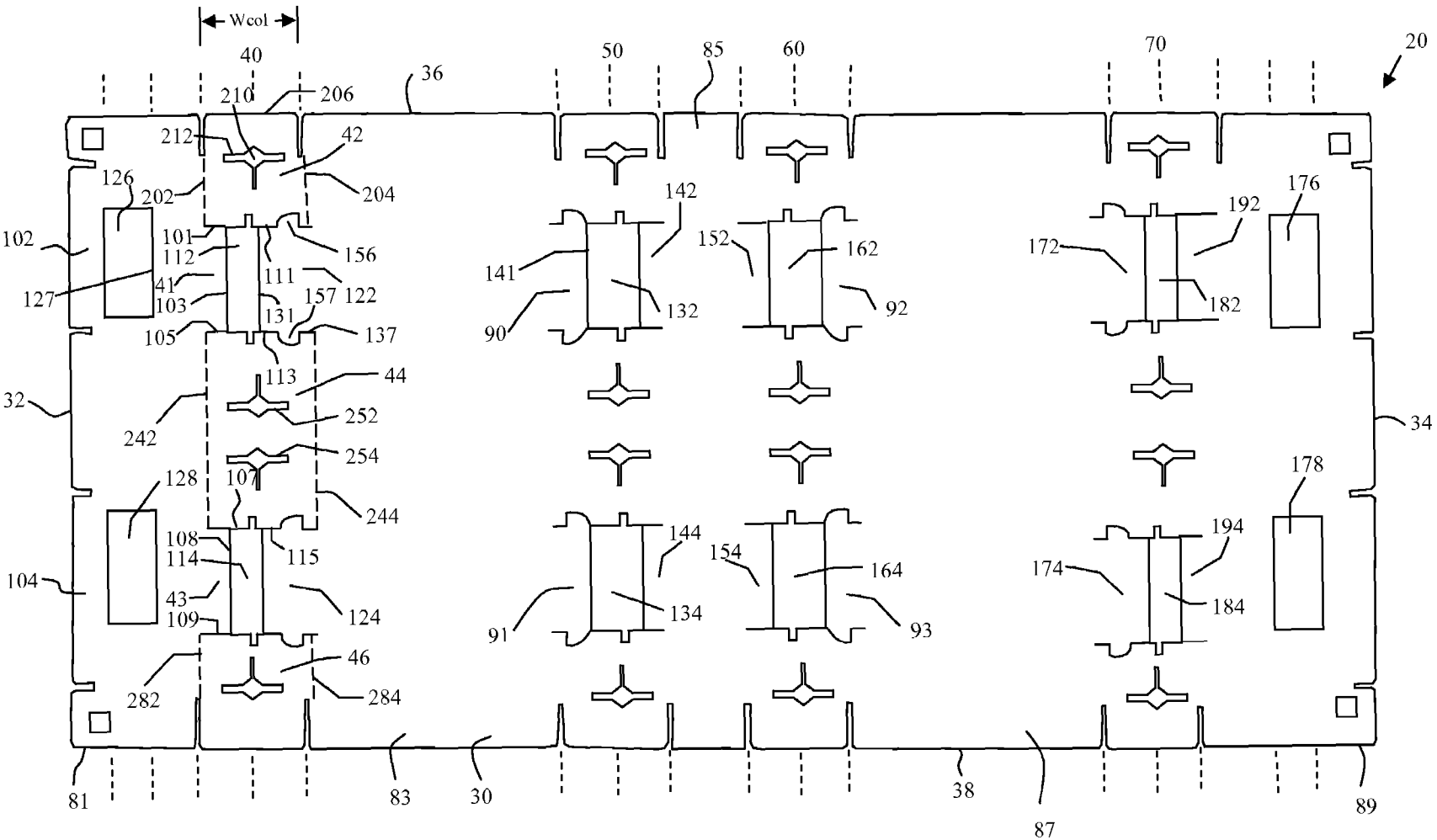
FIG. 2 shows a paperboard top blank according to a preferred form of the present invention.
Figure 3:
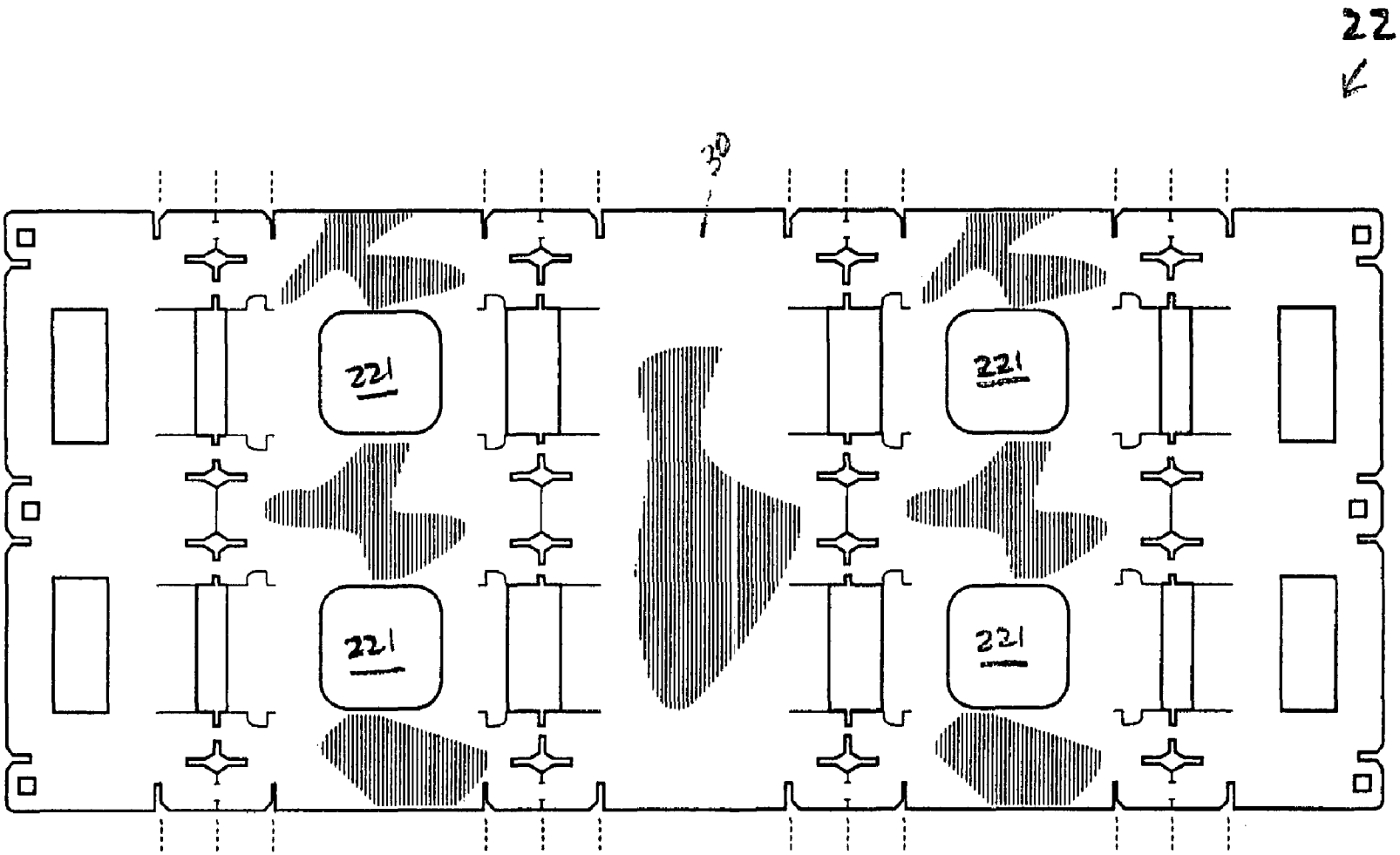
FIG. 3 shows a paperboard bottom blank according to a preferred form of the present invention.

The pallet 10 is preferably constructed by folding a top blank 20 and a bottom blank 22, which are respectively shown in a preferred form in FIGS. 2 and 3. The blanks 20, 22 are die-cut and scored, according to known techniques, from flat sheets of paperboard, which material will be described in greater detail below, and may be assembled by the machine 80 of the present invention to be discussed in the following.

Preferably, the various elements comprising both the bottom and top blanks 20, 22 are similar in form and function, thus a majority of the description of the composition of the blanks 20, 22 will refer specifically only to the top blank 20. Because the elements of both blanks 20, 22 are similar, one reference numeral will be used to illustrate an element similar to both the top and bottom blanks 20, 22. When clarity is required between a similar element of both blanks 20, 22, for example, when describing the foldable construction of the pallet 10, such differentiation between two elements will include the use of the letters "b" and "t" next to a reference numeral, thus referring to a bottom blank element or a top blank element. It will be understood upon reference to the description and the drawing figures that similar elements comprising both top and bottom blanks 20, 22 are designed in similar ways.

For clarity, the detailed description of pallet 10 is broken into two subsections detailing the assembly blanks and the assembly construction.

The Assembly Blanks

The top blank 20 preferably comprises corrugated paperboard or solid paperboard. As used herein, "paperboard" refers to a web of cellulosic fibers in sheet form. The term paperboard includes paper and paperboard of different thicknesses. The preferred paperboard is virgin kraft paperboard of a weight known as linerboard. The corrugated linerboard known in the market at present comprises at least 70% post-consumer linerboard. It has more strength than 100% recycled board because its fibers are generally tougher and the board has fewer impurities. As is well known in the art, a chemical cooking process using sodium hydroxide and sodium sulfide produces kraft paperboard, and there are many different types of kraft paperboard manufactured with various additives and treatments for various applications. The pallet may also make use of reprocessed paperboard, that is, not virgin kraft paperboard.

The top blank 20 of FIG. 2 preferably comprises a bottom panel 30 and bottom foldable column panels 40, 50, 60, 70. Upon foldable construction, the bottom panel 30 of blank 20 remains generally parallel to and in proximity to the floor surface, while the foldable column panels 40, 50, 60, 70 rise to form vertical ribs generally perpendicular to the floor surface. When the top blank 20 is foldably assembled, it forms the lower frame member 12 of the pallet 10. The top blank 20 is generally rectangular in shape, and is bounded by first and second ends 32, 34, and first and second sides 36, 38.

It should be noted that in the following description, references to lengths, widths, and thickness might vary in orientation between the several elements of the pallet 10. For example, the top blank 20 is shown and described as having a length equal to the length of sides 36, 38, a width equal to the length of ends 32, 34, and a thickness equal to the thickness of the blank comprising top blank 20. Yet, when describing various elements of top blank 20, some elements may be described as having a length running parallel to, for example, ends 32, 34 (instead of sides 36, 38), and a width running parallel to sides 36, 38 (instead of ends 32, 34). Additionally, at times, the thickness of an element may relate to a measure in the direction of length or width of blank 20, and not thickness in the sense of the thickness of blank 20.

First, second, third, and fourth bottom foldable column panels 40, 50, 60, 70 of the top blank 20 are shown each comprising three separate column panel sections. For example, first bottom foldable column panel 40 comprises column panel sections 42, 44, 46.

The bottom panel 30 of the top blank 20 has a top face and a bottom face, and, as illustrated in FIG. 2, comprises edge panels 81, 89, jack panels 83, 87, and middle panel 85. Upon manipulation into the assembly 10 of the present invention, the top face of the bottom panel 30 faces upward, inside the assembled invention, and the bottom face points upward, or if assembly 10 is turned over, lies atop the ground or other surface upon which the assembly rests. FIG. 2 illustrates an unassembled or unfolded top blank 20, and therefore depicts the preferred foldable column panels 40, 50, 60, 70 and the elements of the bottom panel 30 in the same plane. Edge panel 81 comprises edge flaps 102, 104 and extends from left to right from first end 32 to first column panel sections 42, 44, 46 and the edge flaps 102, 104.

Jack panel 83 comprises two jack flaps 122, 124 and has cut therethrough two jack passages 126, 128 for the use of a floor jack to lift the constructed pallet 10. Jack panel 83 extends between column panel sections 42, 44, 46 and jack flaps 122, 124, and second column panel 50. Cutouts 112, 114 lie between edge flaps 102, 104 and jack flaps 122, 124, respectively.

An optional middle panel 85 comprises four generally identical flaps, middle flaps 142, 144, 152, 154. Middle panel 85 extends between second and third column panels 50, 60 and the edges of flaps 142, 144 to the edges of flaps 152, 154. Between jack panel 83 and middle flaps 142, 144 lie cutouts 132, 134, respectively.

Jack panel 87 comprises two jack flaps 172, 174 and has cut therethrough two jack passages 176, 178. Jack panel 87 extends between third column panel 60 and fourth column panel 70 and the edges of jack flaps 172, 174. Between middle flaps 152, 154 and jack panel 87 lie cutouts 162, 164, respectively.

Edge panel 89 extends from both fourth bottom column panel 70 and the edges of edge flaps 192, 194 to end 34. Between jack flaps 172, 174 and edge flaps 192, 194 lie cutouts 182, 184, respectively.

Neither the pallet nor the dunnage assembly of the present invention need comprise jack panels 83, 87 with jack passages, as jack panels 83, 87 may be integral throughout without any apertures for inserting a jack. Further, as described under the section on the assembly construction, the number of flaps associated with each panel can vary. At a minimum, adjacent panels need only comprises a single flap, extending from either panel, so the column panel can lock into an upwardly extending rib. For example, as shown in FIG. 2, adjacent panels 81, 83 have between them both four flaps 102, 104, 122, 124 extending from edge panel 81 and jack panel 83, respectively. Adjacent panels 83, 85 have between them both two flaps 142, 144 extending from middle panel 85. Yet in an alternative embodiment, only a single flap extending from either panel 81, 83 and extending from either panel 83, 85 is needed to lock the column panels 40, 50, respectively, into ribs. As will be described, the at least one flap between adjacent panels will comprise a flap lock assembly.

Top and bottom blanks 20, 22 preferably are symmetrical about both a vertical and horizontal line of bisection. Similar elements of the top blank 20 on either side of each line of bisection are generally identical mirror images of one another. Further, first and second column panels 40, 50 are generally identical. Therefore, for purposes of brevity, only edge panel 81, first column panel 40, jack panel 83, and middle panel 85 will be described below in detail. It will be understood that columns 50, 60, 70, jack panel 87, and edge panel 89 are of similar construction to those described.

As shown in FIG. 2, edge panel 81 has two edge flaps 102, 104 extending between column panel sections 42, 44, and 46. Edge sliding flap 41 is defined by edge end 103 and side slits 101, 105 cut into top blank 20. Edge sliding flap 43 is defined by edge end 108 and side slits 107, 109. The end of edge panel 81 distal end 32 of top blank 20 further comprises score lines 202, 242, 282. Side slits 101, 105, 107, 109 and score lines 202, 242, 282 differentiate edge panel 81 from first column panel 40. Score lines 202, 242, 282 preferably lie in a straight line perpendicular to the first and second sides 36, 38 of top blank 20.

First column panel 40 comprises column panel sections 42, 44, 46. Foldable column panel 40 has a width WCOL illustrated as the width between score lines 202, 204 of column panel section 42 and, therefore, each panel section 42, 44, 46 has a width equal to WCOL. As shown in FIG. 2, column panel section 42 is that portion of first column panel 40 enclosed by side portion 206 of side 36, score lines 202, 204, slit 101, and sidecut 111 of cutout 112. Preferably, score lines 202, 204 are parallel, and score line 202 and slit 101 are substantially perpendicular to each other, as are score line 204 and sidecut 111.

As pointed out previously, embodiments of the assembly 10 may comprise only a single flap between adjacent panels, wherein the at least single flap will comprise flap lock assemblies, which flap lock assemblies 137, 139 are described below and shown incorporated in jack flap 122. Thus, if edge panel 81 had the only flap between the adjacent panels 81, 83, which flap extended from edge panel 81 at the location of edge flap 102, the flap would appear in large part like jack flap 122 having locking assemblies 137, 139. Further, in this embodiment, score line 204 and sidecut 111 are substantially perpendicular to each other, while the angle a shown between score line 204 and sidecut 111 in FIG. 5 would exist between score line 202 and slit 101, which angle a between score line 202 and slit 101 would also provide for a locking relationship of the flap extending from the edge panel over jack panel 83, as jack flap 122 would not exist.

Generally centered within column panel section 42 is lock aperture 210. Lock aperture 210 preferably incorporates a locking slot 212 located in lock aperture 210. Column panel section 42 further includes column top panel 220 having a width WRTP (FIG. 4) between score lines 222, 224, spanning the length of the width of panel section 42, yet interrupted through lock aperture 210. Column top panel 220 further preferably divides panel section 42 into column side panels 302, 304 adjacent column top panel 220.

Figures 4, 5, 6:
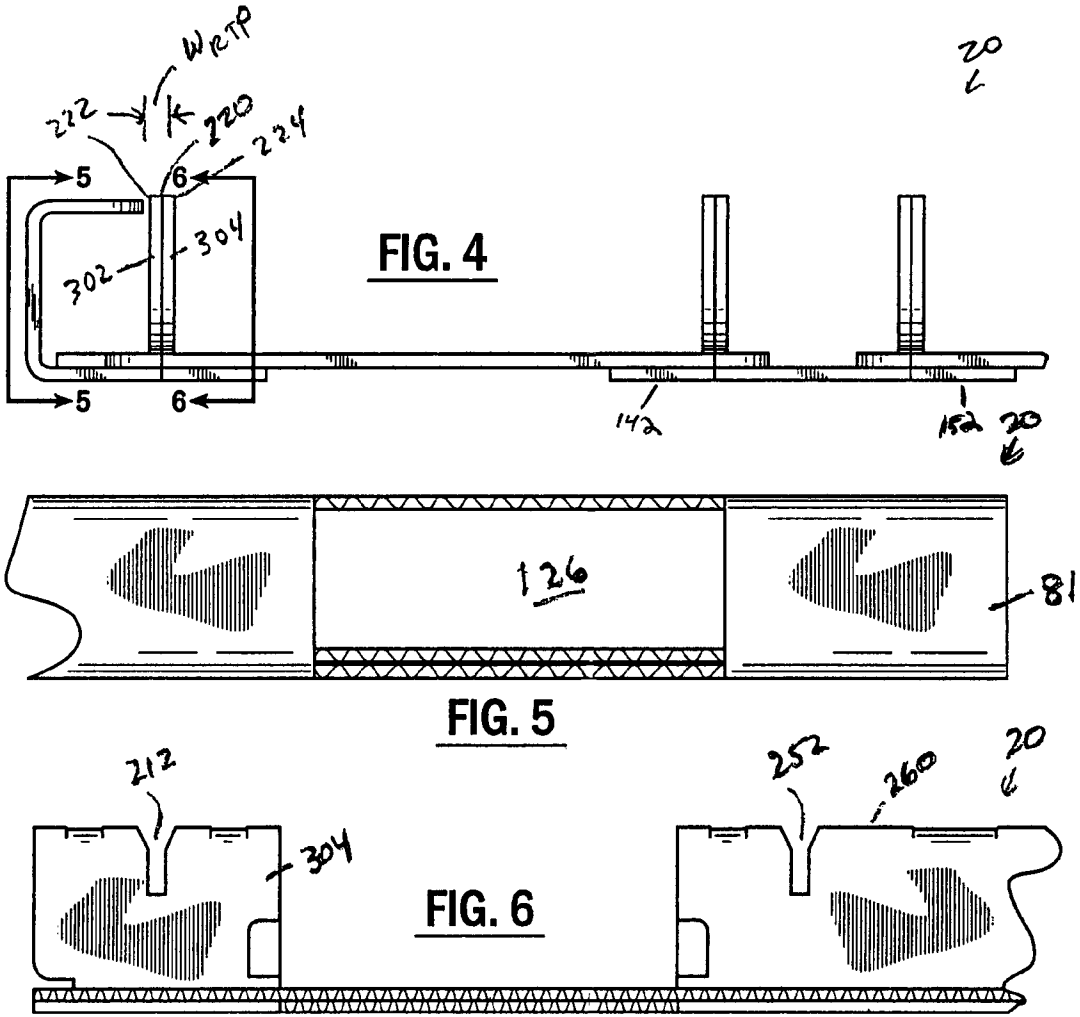
FIG. 4 is a cross-sectional view of a left-hand part of the folded bottom frame member of the blank of FIG. 2.
FIG. 5 is a view of the folded bottom frame member along line 5-5 of FIG. 4.
FIG. 6 is a view of the folded bottom frame member along line 6-6 of FIG. 4.
Figure 9:
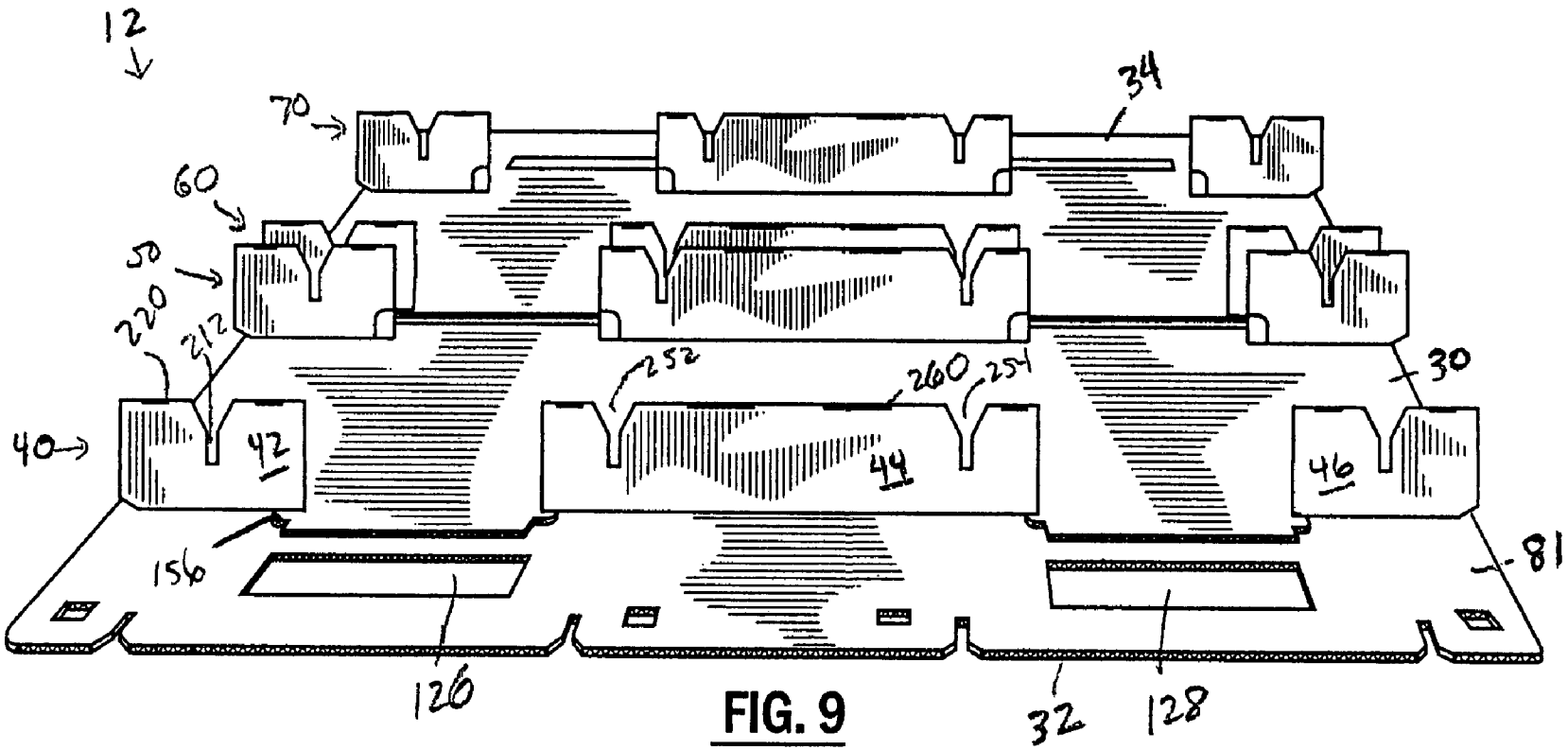
FIG. 9 is a perspective view of the bottom frame member of the present invention, in an assembled configuration.
Figure 10:
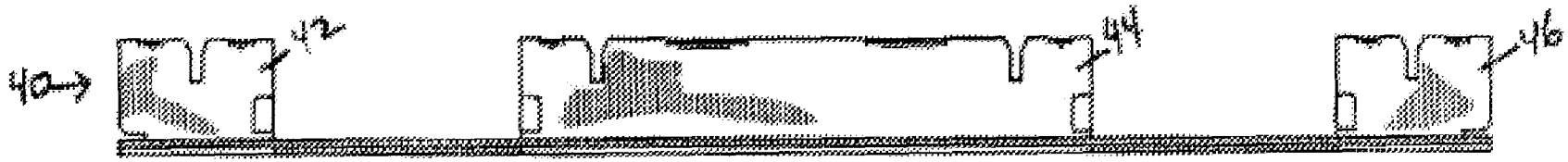
FIG. 10 is a side view of a preferable rib portion of the present invention.

Upon manipulation of column panel section 42 via folding, score lines 202, 204 are drawn together, thus raising rib top panel 220 upward from the flat plane of bottom panel 30, as illustrated in FIGS. 4 and 9, while score lines 222, 224 break and fold approximately 90 degrees. The column side panels 302, 304 rise between score lines 202, 204 and rib top panel 220. In this configuration, column side panels 302, 304 form rib sides 302, 304. Rib sides 302, 304 have side edges. Lock aperture 210 provides a generally flat notch having a bottom in the middle of rib top panel 220.

As shown in FIG. 2, column panel section 44 is that portion of first column panel 40 enclosed by slit 105, sidecut 113 of cutout 112, score lines 242, 244, slit 107, and sidecut 115 of cutout 114. Preferably, score lines 242, 244 are parallel and side slits 105, 107 are substantially perpendicular to score line 242, as are score line 244 and knifecuts 113, 115.

Generally centered along both a first and third line of intersection running perpendicular to score lines 242, 244, while lines separate the length of score lines 242, 244 into four equal segments (the second line of intersection cutting score lines 242, 244 in half) within column panel section 44 are two locking slots 252, 254, both generally identical to locking slot 212 of lock aperture 210. Column panel section 44 further includes column top panel 260 between score lines analogous to score lines 222, 224, spanning the length of panel section 44, yet interrupted through locking slots 252, 254.

Upon manipulation of column panel section 44 through folding, the score lines are brought together, raising column top panel 260 upward from the flat plane of bottom panel 30. Locking slots 252, 254 provide vertical slots cut within rib top panel 260. The orientation of locking slots 252, 254 and column top panel 260 of column panel section 44 preferably align with the locking slot 212 and column top panel 220 of column panel section 42 so that rib top panels 220, 260 and locking slots 212, 252, 254 present continuity of the structure upon folding.

Jack panel 83 has jack flaps 122, 124 and jack passages 126, 128. Jack flap 122 preferably comprises head edge 131, side edges 113, 111, and jack flap lock assemblies 137, 139.

At the base of jack flap 122 are flap lock assemblies 137, 139. Flap lock assemblies 137, 139 preferably include wing tabs 156, 157, which may be approximately equal to two times the thickness of bottom panel 30. Wing tabs 156, 157 provide an unexpected stability and integrity to locking the columns into place which essentially alleviates the need for adhesives. Flap lock assemblies are unexpectedly far superior to the slide lock assemblies, such as that described in U.S. Pat. No. 6,029,582, for several reasons, including, but not limited to, the fact that the wing tabs maintain their integrity as opposed to the slide lock tabs which easily become damaged and rounded off during assembly; and the wing tabs simply hold their lock longer and more securely. When column panel section 42 is folded into a rib portion 40, as further described under The Assembly Construction, the then upwardly extending column side panel 302 of rib portion 40 in proximity to slit 101 is locked into place by wing tab 156.

Middle panel 85 shown in FIG. 2 comprises four middle flaps 142, 144, 152, 154 and four middle locking flaps 90, 91, 92, 93. Each middle locking flap is generally identical to jack flap 122 described in detail above. Middle locking flaps 90, 91, 92, 93 serve the same locking purpose as do jack flaps 122, 124. Middle locking flaps 90, 91 lock into place the ribs formed by folding column panel 50. Middle locking flaps 92, 93 lock into place ribs formed by folding column panel 60. During the folding and locking process of column panels 50, 60, middle flaps 142, 144, 152, 154 slide over an exterior portion of jack panels 83, 87, respectively.

Thus described, top blank 20 comprises a plurality of generally identical foldable column panel sections, flaps, and cutout portions.

Bottom blank 22 as shown in FIG. 3 comprises nearly an identical layout as top blank 20. The bottom panel 30 of the bottom blank 22 has a top face and a bottom face. Upon manipulation into the assembly 10 of the present invention, the top face of the bottom panel 30 faces downward, outside the assembled invention, and the bottom face faces inside the assembled invention. This reference to the top and bottom face of the bottom panel 30 of the bottom blank 22 is opposite the orientation of the top and bottom face of the bottom panel 30 of the top blank 20 because, upon construction of the assembly 10, the top blank 20 is turned upside over the bottom blank 22.

When assembly 10 is formed as a pallet, the top and bottom blanks 20, 22 are preferably sized to foldably produce a conventional 40"×48" pallet. In such a configuration, depending on the thickness of paperboard used, the preferable dimensions of each blank 20, 22 are 40"×77.25" for the top blank 20, and 48"×69.25" for the bottom blank 22. These dimensions provide for a 40"×48" pallet 10 upon folding the blanks 20, 22 and assembling top blank 20 over bottom blank 22 after orientating top blank 20 ninety degrees relative to bottom blank 22, as described under The Assembly Construction.

The number and general shape of each element of the present pallet 10 including the number and shape of column panels, column panel sections, jack passages, and the like are variable between alternative embodiments of the present pallet. For example, bottom panel 20 may comprise six column panels. The two column panels beyond the four illustrated in FIG. 2 would be located one between the first and second column panels 40, 50 and one between third and fourth column panels 60, 70. Each would be shaped and orientated as the proximate first and fourth column panel 40, 70, respectively.

The number of locking slots per each bottom and top foldable column panel preferably equals the number of column panels comprising the opposing blank 20, 22. That is, if the top blank 20 comprises eight foldable column panels, then each column panel of the bottom blank 22 has eight locking slots.

The Assembly Construction

The blanks 20, 22 can be foldably constructed to form a load-bearing assembly 10, as will now be described in greater detail. FIG. 9 shows the top blank 20 of pallet 10 in a partially assembled configuration. Folding of blank 20 will be described from first side 32 to second side 34, although the folding of blank 20 need not follow any particular order.

The first foldable column panel 40 is folded into a rib, rising into a generally perpendicular plane to bottom panel 30, by folding column panel sections 42, 44, 46 upwards from bottom panel 30 about respective score lines 202, 204, 242, 244, and 282, 284. As first foldable column panel 40 begins to take shape as a rib, column top panel 220 of column panel section 42 is folded about score lines 222, 224 and becomes rib top panel 220 that lies in a generally parallel plane to the plane of bottom panel 30. Each column top panel of each panel section 44, 46 is similarly folded.

Figure 12:
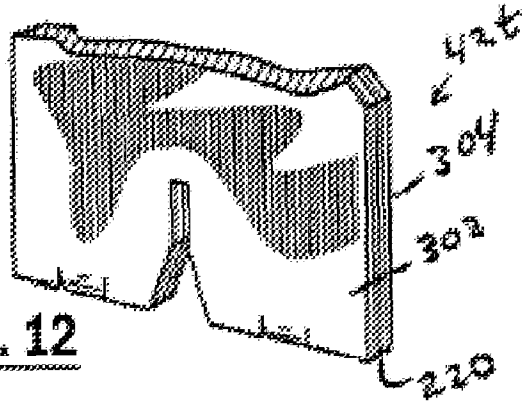
FIG. 12 is a perspective view of a locking slot of a rib portion of the present invention.

The column panel 40 continues to fold upward from panel 30 as score lines 202, 242, 282 are brought nearer to score lines 204, 244, 284, respectively. Preferably, each set of score lines abuts one another (for example, score line 202 abuts score line 204), and side panels 302, 304 are closely opposed, as seen in FIG. 12.

As rib 40 is folded, jack flaps 122, 124 are necessarily brought toward edge flaps 102, 104, over cutouts 112, 114. The jack flaps are folded down over edge flaps 102, 104 and the locking assemblies 137, 139 of jack flaps 122, and the corresponding locking assemblies of jack flap 124 (not numbered), lock into place the rib formed by folding column panel 40.

The second column panel 50 is folded into a rib just as column panel 40. Similar to the locking of jack flaps 122, 124 over edge panel 81, middle locking flaps 90, 91 span across cutouts 132, 134 and fold over jack panel middle panel 85. This process it repeated until all the ribs are locked in an upright configuration producing lower frame 12 (FIG. 9).

The bottom blank 22 of an assembly 10 comprising bottom blank 22 folds into a locked configuration just as described for top blank 20. This locking process is repeated for bottom blank 22, thus providing the upper frame 14 of assembly 10.

The folded configurations of lower and upper frames 12, 14 are releasably secured against unfolding by the flap lock assemblies. The folded configurations of lower and upper frames 12, 14 can be fixedly secured against unfolding by frame fixed securing means. For example, frame fixed securing means can comprise an adhesive placed on the top faces of edge flaps 102, 104, or the bottom faces of jack flaps 122, 124, or both, to fixedly secure rib 350 in its folded state by adhesively securing the position of edge flaps 102, 104 over jack flaps 122, 124. Other frame fixed securing means can comprise tape, staples, other diecut locking configurations, and the like. As described above, the unexpected strength of the above described locking assemblies makes the use of securing means optional, and in some cases not preferred.

After the bottom and top blanks are folded, the assembly 10 is formed by rotating the bottom or top blank 20, 22 ninety degrees relative to the other blank. Then the top blank 20 is flipped upside down so the ribs such as 42*t* extend downward toward the upwardly extending ribs such as 42*b* of bottom blank 22. The blanks 20, 22 are then brought together so the locking slots of each rib on one blank engage the locking slots of ribs of the other blank. As shown in FIG. 1, because the blanks are rotated 90 degrees relative to each other, the upper frame ribs and the lower frame ribs form crisscrossing rows and columns of ribs. The additional side walls formed by flaps 102, 104, for example, provide additional strength over the pallet of the 582 patent.

Figure 13:
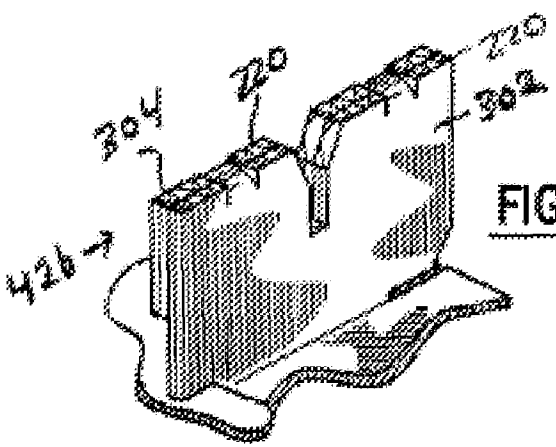
FIG. 13 is a perspective view of a locking slot of another rib portion of the present invention, which rib portion engages the rib portion of FIG. 12 upon construction of the present assembly.
Figure 11:
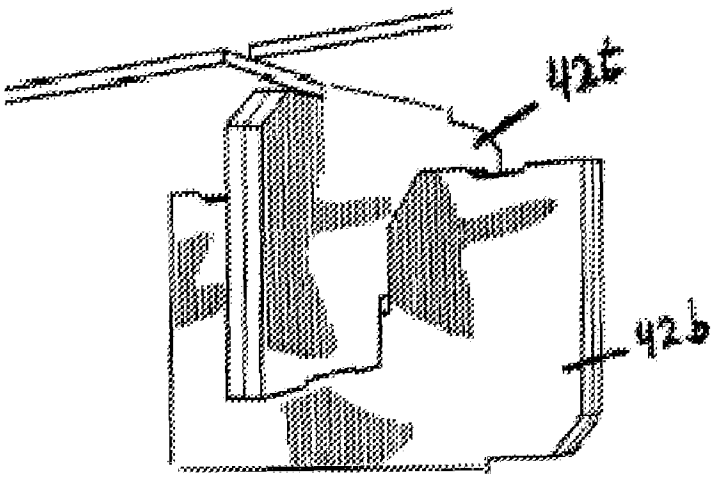
FIG. 11 is a perspective view of an assembled force resisting assembly according to one embodiment of the present invention.
Figure 14:
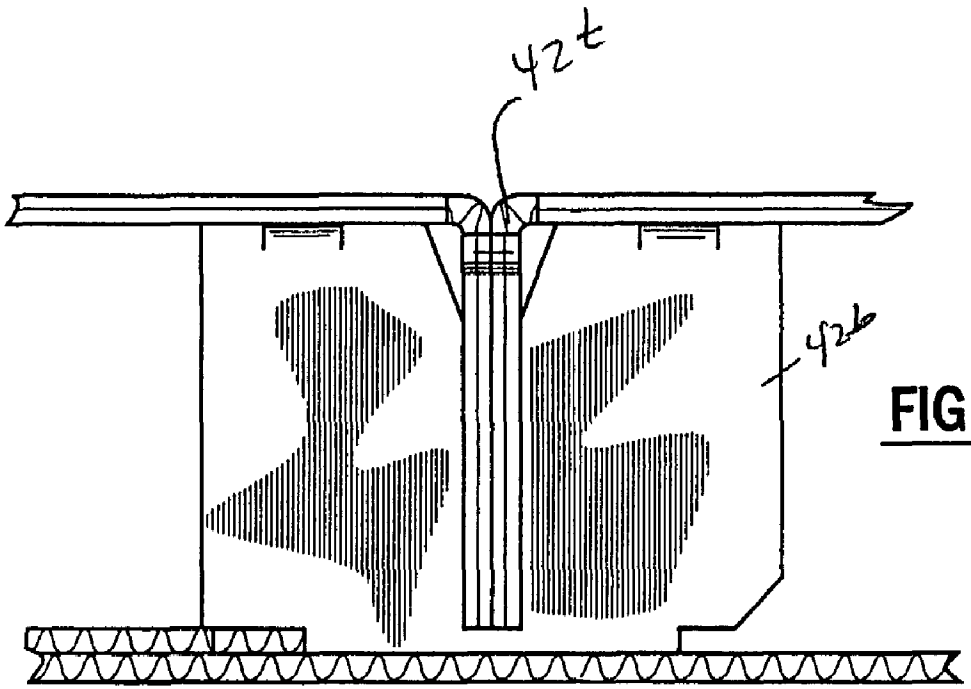
FIG. 14 is a side view of the engagement of the rib portions of FIGS. 12 and 13.

FIG. 13 illustrates a constructed blank or dunnage assembly 10. A rib formed by column panel 40*t* of top panel 42 engages the locking slots of rib portions formed by column panel sections 46*b*, 56*b*, 66*b*, 76*b* of bottom column panels 40*b*, 50*b*, 60*b*, 70*b*, respectively.

The assembled configuration of lower and upper frames 12, 14 is releasably secured against separation by the interconnecting locking slots. The assembled configuration of lower and upper frames 12, 14 can be fixedly secured against separation by assembly fixed securing means. For example, assembly fixed securing means can comprise an adhesive placed on the top surfaces of rib top panels of each panel section, to, for example, fixedly secure each rib top panel of the upper frame 14 to the bottom panel 30 of the lower frame 12. Other assembly fixed securing means can comprise tape, staples, diecut locks such as shown on FIGS. 1 and 2, comprising separation locks, and the like.

Furthermore, the assembled configuration of the lower and upper frames 12, 14 provide for a unique peripheral structure that adds additional stability to the assembled pallet. Namely the incorporation of edge panels which are folded and locked into place during the assembly of frame and bringing together of frames to form the pallet provide a tight secure construction at the periphery of the pallet, versus prior art pallets such as that described in U.S. Pat. No. 6,029,582, wherein the periphery of the pallet is subject to compression and shear forces.

Figure 8:
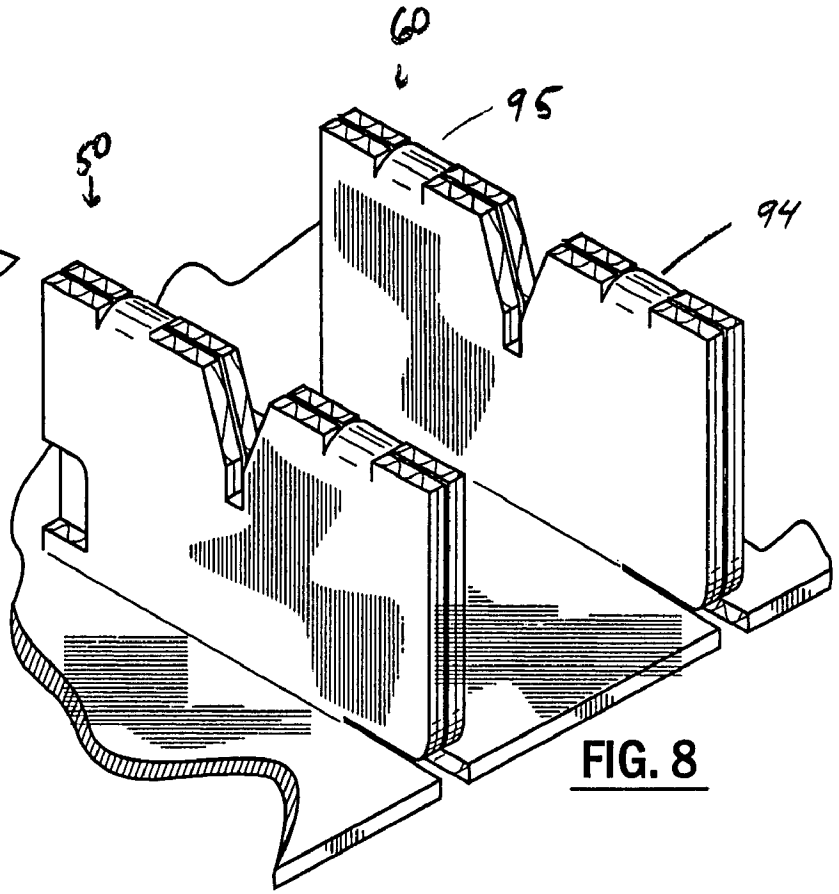
FIG. 8 illustrates a preferred middle panel of the blank of FIG. 2.
Figure 7:
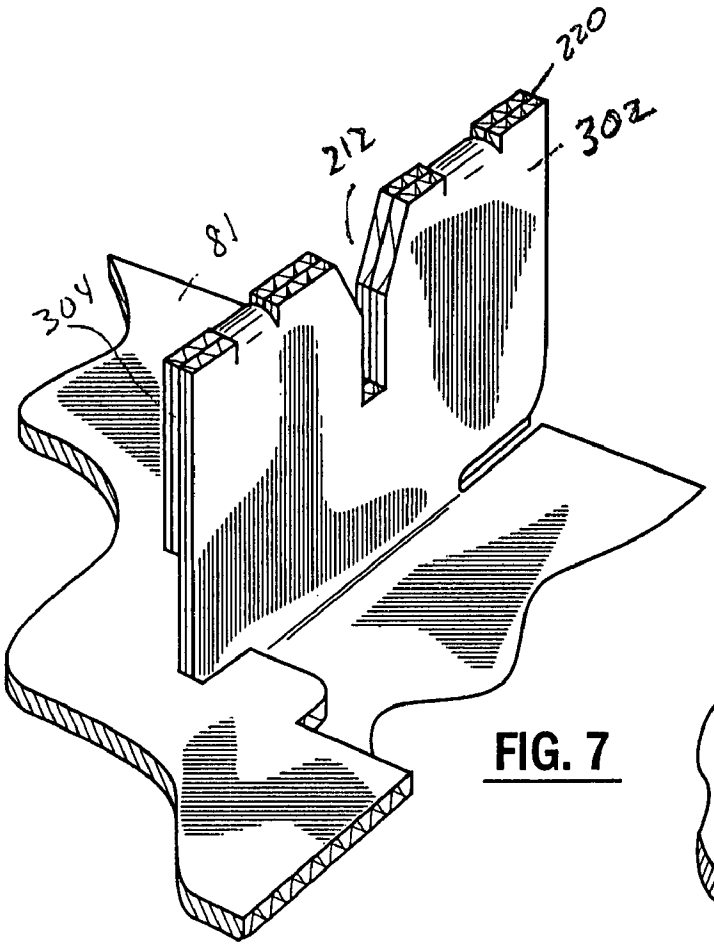
FIG. 7 illustrates a preferred jack panel of the blank of FIG. 2.

An additional feature of the subject pallet or dunnage system comprises the unique cutting and scoring of the column panels to define bridge cuts 94, 95 (FIG. 8). When using high strength corrugated materials, and other strong materials, the implementation of scoring alone makes folding and assembly of the pallet very difficult. This is because, even with scoring, the material still resists folding. With the unique bridge cuts feature, the material is much easier to fold at the desired strategic locations. This results in an increase of overall stability and integrity of the pallet, as the material lies into place better, and damage brought about by forcing the material is avoided.

It will be understood by one of skill in the art that the terms "upper" and "lower" and "bottom" and "top" are relative, and that the pallet 10 may be used in either orientation. It is in fact believed preferable to have the orientation inverted from that which is shown above, as the apertures 221 in element 22 provide access to pallet jack wheels to make contact with the floor. The apertures 221 are an advantageous feature, but the present pallet may be designed without providing such apertures.

Figure 15:
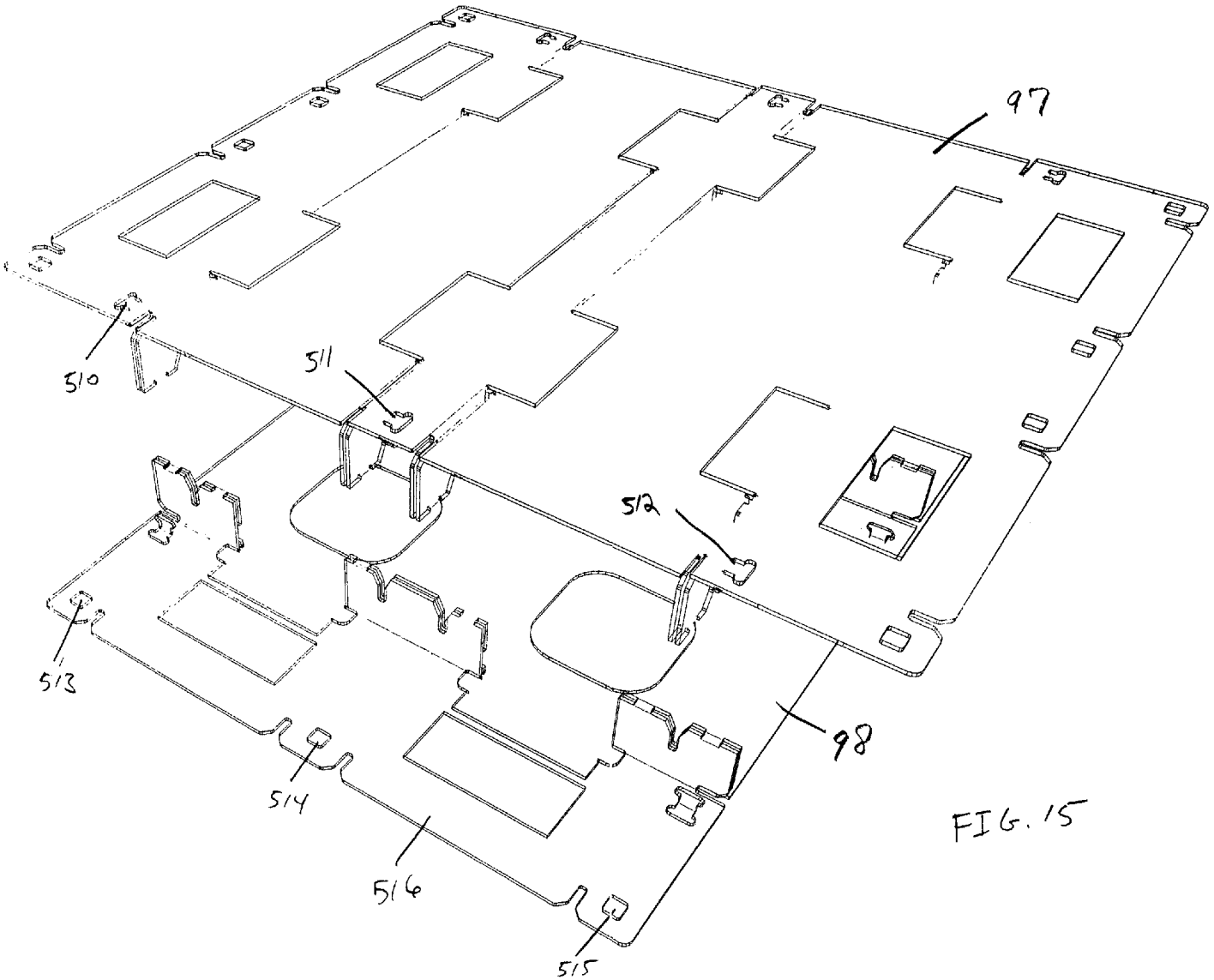
FIG. 15 is a perspective view of a diagram which shows an embodiment comprising tab locks to further increase stability and integrity of pallet.

FIG. 15 shows a diagram of two frames 97, 98 similar to frames 12, 14 described above. Frame 97 comprises tab locks such as 510, 511, 512. Preferably, the tab locks are provided proximate to the periphery of frames 97, 98. In locking together frames 97, 98, edge flap 516 is folded over, tab locks 510, 511, 512 are pushed through holes 513, 514, 515, respectively, and locked into place. This is repeated at every edge flap until pallet is fully assembled. Tab locks provide additional strength and stability to the assembled pallet. The edge flap 516 comprises slots such as 520, 521. These slots slide into slots slide into slots 519, 522, respectively until the most interior portions 523, 524 abut against most interior portions 525, 526 respectively. Slots 519, 520, 521, 522 allow the edge flap 516 to fully slide into position, which increases structural stability.

Other Embodiments and Features

Figure 16:
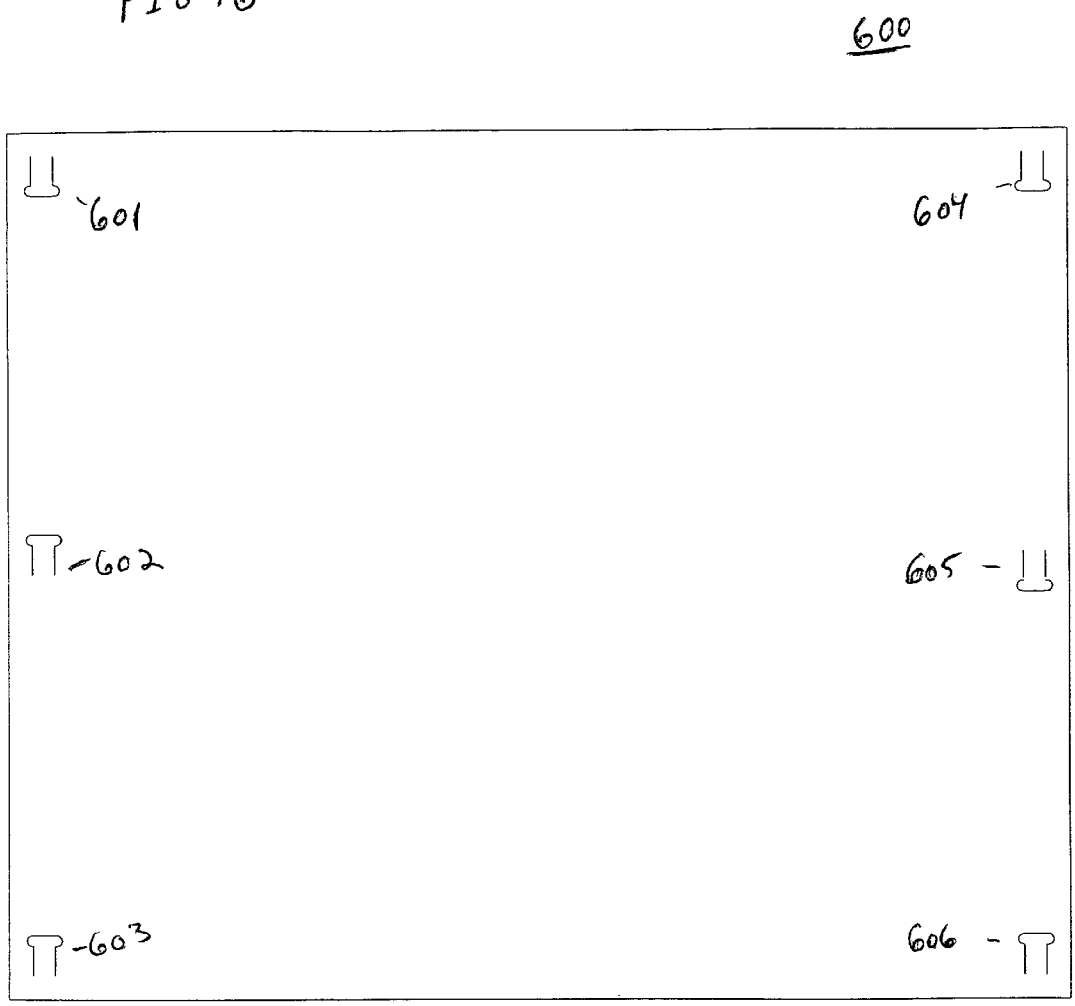
FIG. 16 is a top view of a flat attachment embodiment which may be attached to the pallet so as to provide a flat top surface.

In some instances, it is desirable to have a pallet that possesses an even flat top or bottom surface. FIG. 16 shows a diagram of a flat attachment embodiment 600 that may be attached to the top of an assembled pallet. The flat attachment 600 is locked into place by tab locks 601, 602, 603, 604, 605 which are locked into holes defined in the assembled pallet.

Figure 17:
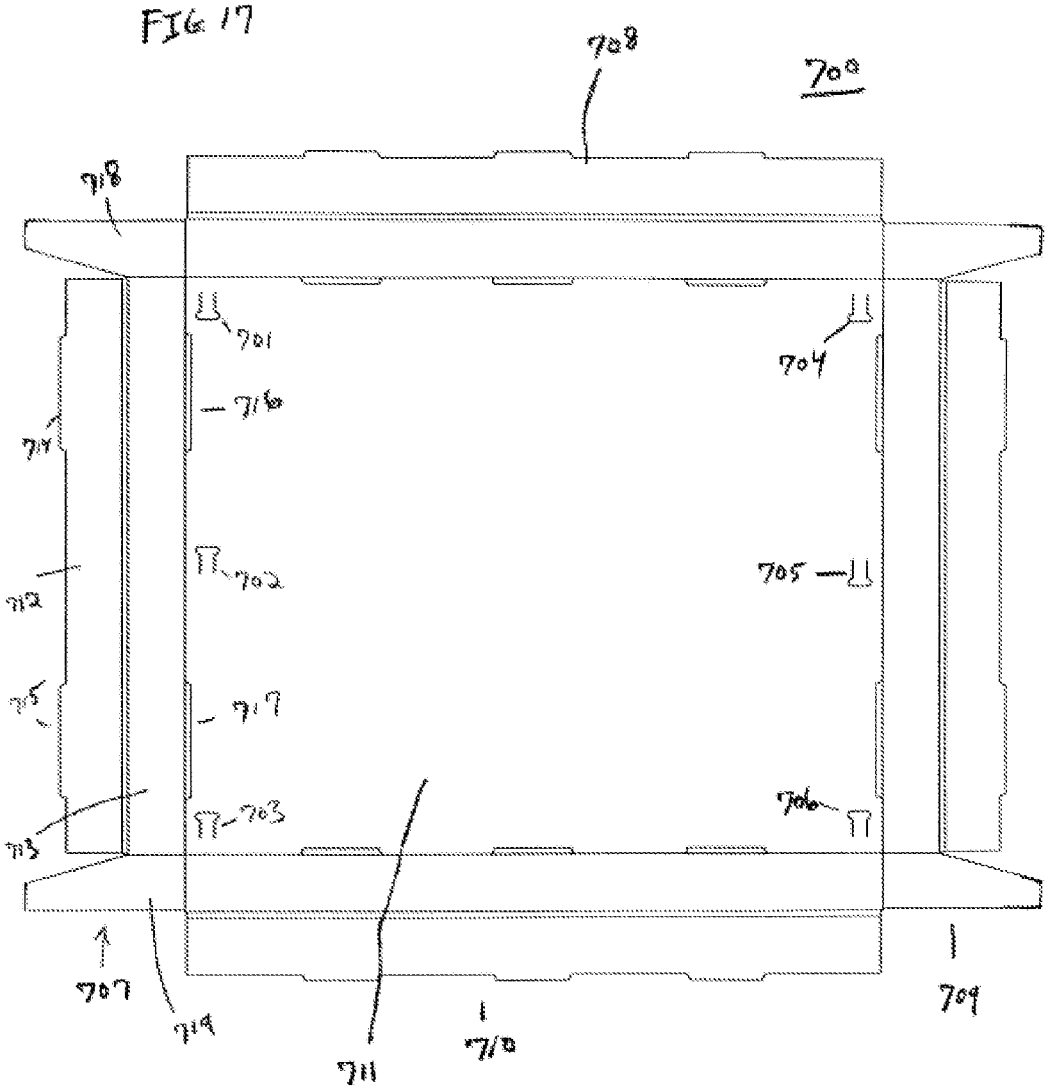
FIG. 17 is a top view of a tray attachment embodiment which may be attached to the pallet.

For some applications, it is desirable to have a more flat surface as well as a means to hold items onto the pallet. FIG. 17 shows a diagram of a tray attachment embodiment 700 that may be attached to the top of pallet as described herein. As with the flat attachment 600, tray attachment comprises tab locks 701, 702, 703, 704, 705, 706 to secure the attachment into place. Furthermore, the tray attachment comprises tray side walls 707, 708, 709, 710 which may be folded and secured to center panel 711. Looking to side wall 707 for example, it comprises an edge portion 712, medial portion 713. The edge portion comprises secure tabs 714, 715. Upon assembly, the edge portion 712 folds over medial portion and tabs 714, 715 lock into slits 716, 717 of center panel 711. The wing flaps 718, 719 will fold under side walls 708, 709, respectively. Sidewalls 708, 709, 710 are folded, similarly.

Further, those skilled in the art will appreciate that several different types of attachments may be provided and secured to the present pallet. For example, different types of partitions may be constructed to attach to the subject pallet system. Partitions could be used for example to partition 2 liter bottle containers, or containers of many different sizes and shapes. Further, a top partition could be constructed whereby partitions are secured from a top cover to go over the covered goods. Further still, layers of goods and pallets could be formed with partitions secured to both the top and bottom of middle pallets.

Figure 18:
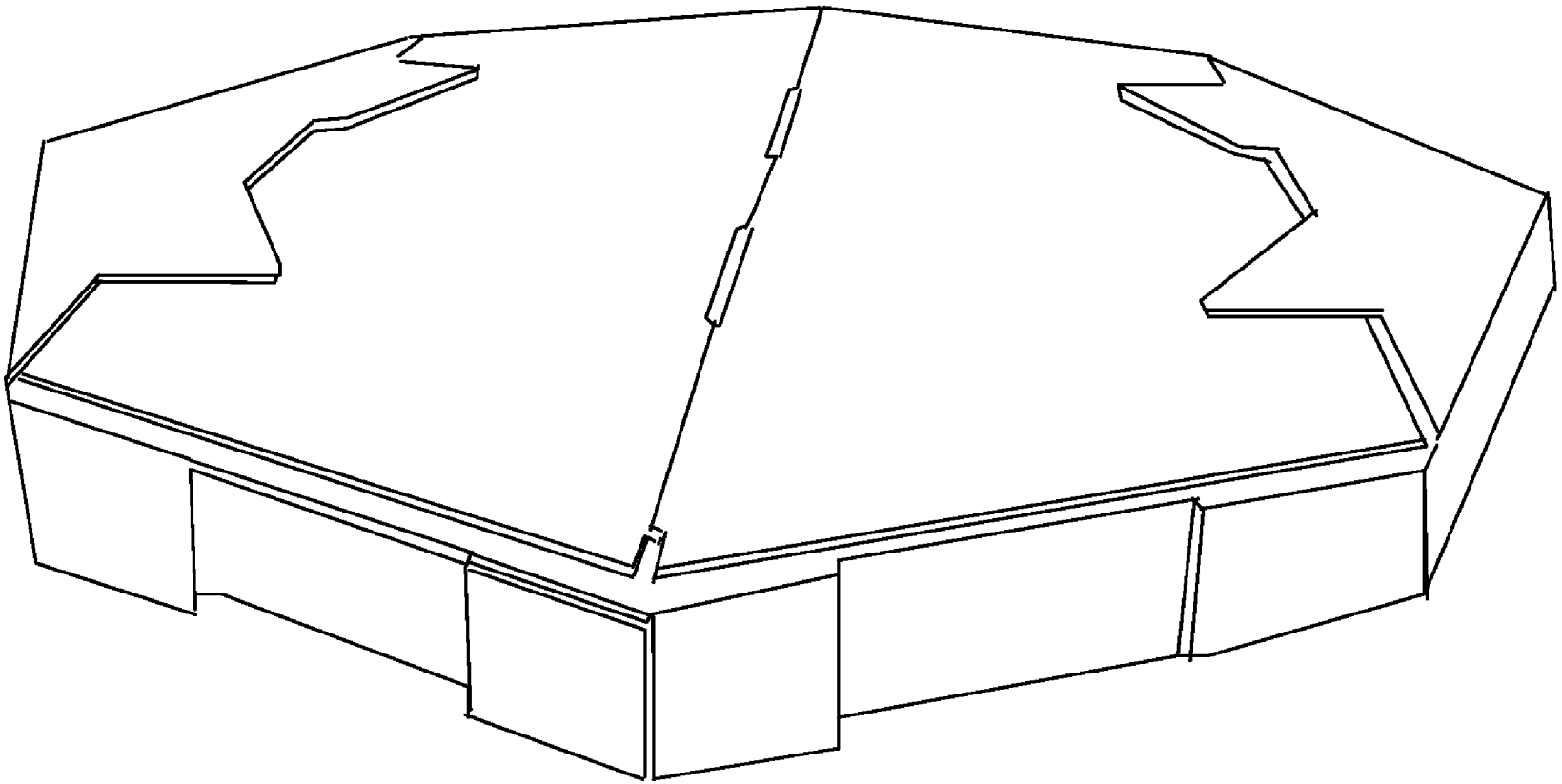
FIG. 18 is a perspective view of an alternative pallet embodiment configure to form an octagonal shape.

Those skilled in the art will appreciate that the many advantageous features of the present pallet many be provided in pallets of different shapes and forms. FIG. 18 shows a pallet configured in dimensions to form an octagonal shape. The octagonal shape is particularly preferred as the "honeycomb" nature of the shape allows for tight placement of pallets in trucks, warehouses, ships etc. The ribs of the octagon may be defined, assembled, and locked into place in accord with the teachings above. Those skilled in the art will appreciate that the pallet may take the form of other shapes, including, but not limited to, circles, triangles, squares, and hexagon and other polygonal shapes.

In the above described preferred embodiments, assembled pallets are shown that have four passages, thus allowing a forklift or other device to pass through either axis of the pallet. In some instances, it is advantageous to have a side surface on which advertising or other information may be displayed or printed. The edge panels of the pallet can be configured to provide opposing closed sides, such that passages are defined on only one axis not two. The closed side provides a full side surface to display information.

Furthermore, the configuration of the subject pallets provides an additional benefit to the user. In prior art pallets, the ends of the pallets are not closed end, and therefore do not provide a passage way that is easy to see to the user, such as a forklift operator. In prior art pallets, such as that taught in U.S. Pat. No. 6,029,582, the passageways are hard to see. As a result, a forklift operator can easily miss the passageway, thereby ramming the forklift into the pallet in the wrong position and damaging the pallet. The subject invention provides an easy to visualize passageway even from higher elevations so that damage of this sort is avoided.

The teachings of the references cited throughout the specification are incorporated herein by this reference to the extent they are not inconsistent with the teachings herein. It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A force resisting corrugated assembly foldably constructed from a generally flat blank, said assembly comprising:

(a) a first frame, said first frame comprising at least two jack panels; at least three ribs, said ribs formed by folding said blank at predetermined locations and locked into place by folding lock assemblies; and first and second edge panels defined on first and second ends, respectively, of said first frame, each of said first edge panel and said second edge panel comprising at least two jack passages defined therein and sized for allowing passage by a jack and comprising an edge flap, wherein each of said first and second edge panels folds over to form an outer peripheral structure substantially extending the length of said first and second ends and said edge flap folds over toward said at least three ribs; and (b) a second frame, said second frame comprising at least two jack panels; at least three ribs, said ribs formed by folding said blank at predetermined locations and locked into place by folding lock assemblies; and first and second edge panels defined on first and second ends, respectively, of said second frame, each of said first edge panel and said second edge panel comprising at least two jack passages defined therein and sized for allowing passage by a jack and comprising an edge flap, wherein each of said first and second edge panels folds over to form an outer peripheral structure substantially extending the length of said first and second ends and said edge flap folds over toward said at least three ribs;

wherein said ribs of first and second frames comprise locking slots;

wherein said first and second edge panels of said first frame comprise tab locks and said edge flap of said first and second edge panels of said first frame comprises tab holes;

wherein said first and second edge panels of said second frame comprise tab locks and said edge flap of said first and second edge panels of said second frame comprises tab holes;

wherein said first and second frames are brought together in a perpendicular fashion such that the ribs of the first frame lock into place with the ribs of the second frame;

wherein said edge flap of said first and second edge panels of said first frame is secured to said second frame via locking of said tab locks of said first and second edge panels of said second frame with said tab holes of said edge flap of said first and second edge panels of said first frame;

wherein said edge flap of said first and second edge panels of said second frame is secured to said first frame via locking of said tab locks of said first and second edge panels of said first frame with said tab holes of said edge flap of said first and second edge panels of said second frame; and wherein said first frame and second frame when brought together form an assembly comprising four sides with an outer peripheral structure on each of said four sides.

2. The corrugated assembly of claim 1, wherein said edge panels of said first and second frames are folded over and secured into place, before, during or after the ribs of said first and second frames are locked into place.

3. The assembly of claim 1, further comprising an attachable tray configured for attachment to the corrugated assembly wherein said tray is assembled from a generally flat blank and comprises a plurality of tab locks for attachment to said corrugated assembly.

4. The attachable tray of claim 3, wherein said tray is rectangular and comprises a wall on all four sides upon being assembled.

5. The corrugated assembly of claim 1, wherein said ribs of first frame and the ribs of said second frame are further secured together by application of an adhesive.

6. The corrugated assembly of claim 1, wherein the corrugated assembly is coated with a water resistant coating.

7. The corrugated assembly of claim 6, wherein said water resistant coating is a water-dispersible polymer suspension.

* * * * *